US008974253B2

(12) United States Patent
Drijfhout et al.

(10) Patent No.: US 8,974,253 B2
(45) Date of Patent: Mar. 10, 2015

(54) CONTACT MODULE FOR A RECEPTACLE ASSEMBLY

(71) Applicant: Tyco Electronics Netherland B.V., 's-Hertogenbosch (NL)

(72) Inventors: Tekke Drijfhout, Nistelrode (NL); Albert Pieter Jan Mooij, Hedel (NL); Rutger Wilhelmus Smink, Achel (BE); Ronald Nico Adriaan Daamen, Vught (NL)

(73) Assignee: TE Connectivity Nederland B.V., 'S-Hertogenbosch (NL)

( * ) Notice: Subject to any disclaimer, the term of this patent is extended or adjusted under 35 U.S.C. 154(b) by 98 days.

(21) Appl. No.: 13/907,106

(22) Filed: May 31, 2013

(65) Prior Publication Data

US 2014/0357133 A1 Dec. 4, 2014

(51) Int. Cl.
*H01R 13/502* (2006.01)
*H01R 13/504* (2006.01)

(52) U.S. Cl.
CPC ..... *H01R 13/504* (2013.01)
USPC ..... 439/701

(58) Field of Classification Search
CPC ..... H01R 13/504
USPC ..... 439/79, 607.05–607.07, 701
See application file for complete search history.

(56) References Cited

U.S. PATENT DOCUMENTS

| | | | | |
|---|---|---|---|---|
| 8,529,300 | B2 * | 9/2013 | Ritter et al. | 439/701 |
| 8,708,756 | B2 * | 4/2014 | Lee et al. | 439/701 |
| 8,771,023 | B2 * | 7/2014 | De Bruijn | 439/701 |
| 2008/0214059 | A1 * | 9/2008 | Rothermel et al. | 439/701 |
| 2010/0144204 | A1 * | 6/2010 | Knaub et al. | 439/607.07 |

* cited by examiner

*Primary Examiner* — Khiem Nguyen

(57) ABSTRACT

A contact module includes an overmolded leadframe with frame members separated by corresponding gaps and a removable insert coupled to a corresponding receptacle signal contacts. The removable insert has a main wall, end walls extending from the main wall and forming a receiving space therebetween, and a finger extending from the main wall in the receiving space. First and second channels are formed between the finger and the corresponding end walls that receive the contacts. The finger and end walls hold the lateral positions of the contacts during the overmolding process. The receiving space is filled with dielectric material during overmolding and the removable insert leaves a window in the corresponding frame member that exposes the corresponding receptacle signal contacts.

20 Claims, 11 Drawing Sheets

CONTACT MODULE FOR A RECEPTACLE ASSEMBLY

BACKGROUND OF THE INVENTION

The subject matter herein relates generally to contact modules for receptacle assemblies.

Some electrical systems, such as network switches and computer servers with switching capability, include receptacle connectors coupled to circuit boards, such as backplanes, daughtercards, switch cards, line cards and the like. The receptacle connectors typically include individual contact modules or chicklets that have signal contacts configured to be terminated to the circuit boards. Some conventional contact modules include overmolded leadframes. The conductors of the leadframes are typically held during the overmolding process by pinch pins. The pinch pins are blunt round pinch pins that press against opposite sides of the conductors to hold the conductors during overmolding.

The conventional overmolding process is not without disadvantages. For instance, the dielectric material that is injected into the mold used to form the contact module tends to press against the conductors and cause the conductors to move during the overmolding process. Lateral offset of the conductors from the designed nominal position causes signal integrity issues.

A need remains for an improved contact module. A need remains for components and methods of fixing lateral positions of conductors during overmolding to maintain proper signal integrity.

BRIEF DESCRIPTION OF THE INVENTION

In one embodiment, a contact module for a receptacle assembly is provided that includes a frame assembly having first and second frames coupled together. The first and second frames each have a corresponding leadframe having a plurality of receptacle signal contacts. The first and second frames each have at least two frame members spaced apart from each other by a corresponding gap. Each frame member is overmolded over and supports corresponding receptacle signal contacts. The first and second frames are interested such that at least one frame member of the first frame is received in a corresponding gap of the second frame and such that at least one frame member of the second frame is received in a corresponding gap of the first frame. The receptacle signal contacts are supported by corresponding removable inserts during overmolding of the corresponding frame members. Each removable insert leaves a window in the corresponding frame member exposing the corresponding receptacle signal contacts. The first frame includes a first dielectric insert extending from a corresponding frame member of the first frame into the gap. The first dielectric insert is received in a corresponding window in the second frame to substantially fill the window and cover the corresponding receptacle signal contacts of the second frame. The second frame includes a second dielectric insert extending from a corresponding frame member of the second frame into the gap. The second dielectric insert is received in a corresponding window in the first frame to substantially fill the window and cover the corresponding receptacle signal contacts of the first frame.

Optionally, the removable insert may hold lateral positions of the receptacle signal contacts relative to each other during overmolding. The removable insert may include a finger positioned between the corresponding receptacle signal contacts to hold a lateral position of the receptacle signal contacts relative to one another. The first dielectric insert may have a complementary shape as the corresponding removable insert to substantially fill the window left by removal of the removable insert.

Optionally, the removable insert may include a main wall, end walls extending from the main wall and forming a receiving space therebetween, and a finger extending from the main wall in the receiving space. First and second channels may be formed between the finger and the corresponding end walls. The first and second channels may receive the receptacle signal contacts. The finger and end walls may hold the lateral positions of the receptacle signal contacts relative to each other during the overmolding process. The receiving space may be filled with dielectric material during overmolding of the corresponding frame member.

Optionally, the removable insert may maintain a predetermined spacing between a differential pair of receptacle signals contacts as the dielectric material of the frame member is overmolded to form the corresponding frame member. The frame members may include edges facing corresponding gaps. The edges at the windows may be inset such that the frame member is narrower at the window than along segments of the frame member adjacent the window.

In another embodiment, a contact module for a receptacle assembly is provided including a frame having a leadframe that includes a plurality of receptacle signal contacts and frame member overmolded over corresponding receptacle signal contacts. The frame members are separated by corresponding gaps. A removable insert is coupled to a corresponding receptacle signal contacts. The removable insert has a main wall, end walls extending from the main wall and forming a receiving space therebetween, and a finger extending from the main wall in the receiving space. First and second channels are formed between the finger and the corresponding end walls. The first and second channels receive the receptacle signal contacts. The finger and end walls hold the lateral positions of the receptacle signal contacts relative to each other during the overmolding process. The receiving space is filled with dielectric material during overmolding of the corresponding frame member. The removable insert leaves a window in the corresponding frame member after the removable insert is removed. The window exposes the corresponding receptacle signal contacts.

DETAILED DESCRIPTION OF THE INVENTION

Figure 1:
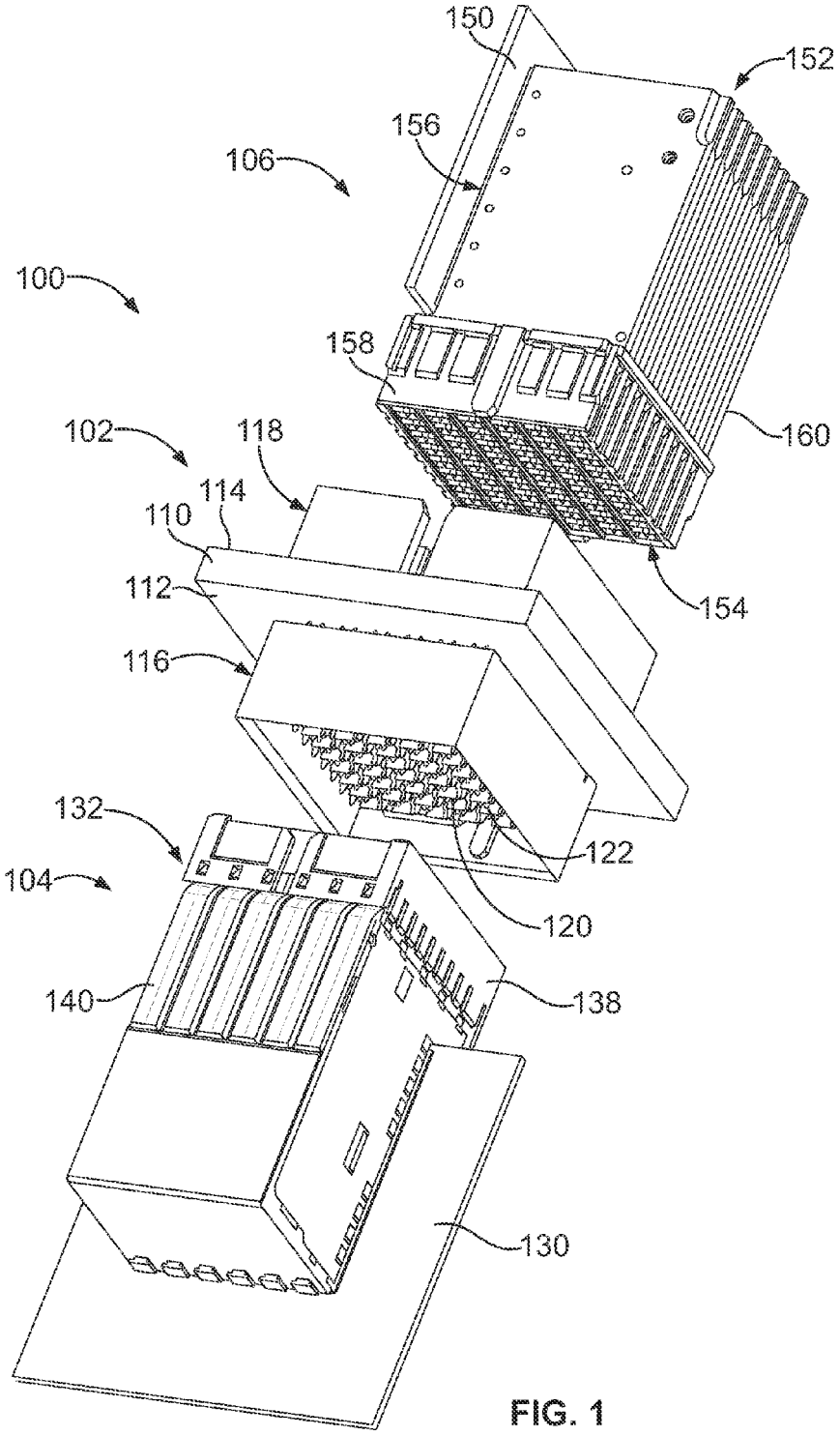
FIG. 1 is a perspective view of a connector system formed in accordance with an exemplary embodiment.

FIG. 1 is a perspective view of a connector system 100 formed in accordance with an exemplary embodiment. The connector system 100 includes a midplane assembly 102, a first connector assembly 104 configured to be coupled to one side of the midplane assembly 102 and a second connector assembly 106 configured to be connected to a second side the midplane assembly 102. The midplane assembly 102 is used to electrically connect the first and second connector assemblies 104, 106. Optionally, the first connector assembly 104 may be part of a daughter card and the second connector assembly 106 may be part of a backplane, or vice versa. The connector assemblies 104, 106 may be part of a cabled backplane system. The first and second connector assemblies 104, 106 may be line cards or switch cards. Alternatively, the connector assemblies 104, 106, with modification, may be directly connected without the use of the midplane assembly 102.

The midplane assembly 102 includes a midplane circuit board 110 having a first side 112 and second side 114. The midplane assembly 102 includes a first header assembly 116 mounted to and extending from the first side 112 of the midplane circuit board 110. The midplane assembly 102 includes a second header assembly 118 mounted to and extending from the second side 114 of the midplane circuit board 110. The first and second header assemblies 116, 118 each include header signal contacts 120 electrically connected to one another through the midplane circuit board 110.

The midplane assembly 102 includes a plurality of signal paths therethrough defined by the header signal contacts 120 and conductive vias that extend through the midplane circuit board 110. Each signal path through the midplane assembly 102 is defined by a header signal contact 120 of the first header assembly 116 and a header signal contact 120 of the second header assembly 118 both received in a common conductive via through the midplane circuit board 110. In an exemplary embodiment, the signal paths pass straight through the midplane assembly 102 along linear paths. Such a design of the midplane circuit board 110 is less complex and less expensive to manufacture than a circuit board that routes traces between different vias to connect the first and second header assemblies 116, 118.

In an exemplary embodiment, the first and second header assemblies 116, 118 may be identical to one another. Having the first and second header assemblies 116, 118 identical to one another reduces the overall number of different parts that are needed for the connector system 100. The first and second header assemblies 116, 118 may have an identical pinout allowing the first and second header assemblies 116, 118 to be mounted to the midplane circuit board 110 using conductive vias that pass straight through the midplane circuit board 110 between the first side 112 and the second side 114. The first and second header assemblies 116, 118 are not rotated 90° relative to one another as is typical of conventional connector systems, and thus do not suffer from a loss in density or a loss in performance as is typical of such connector systems. The header assemblies 116, 118 may be rotated 180° relative to one another to facilitate different card positions.

The first and second header assemblies 116, 118 include header ground shields 122 that provide electrical shielding around corresponding header signal contacts 120. In an exemplary embodiment, the header signal contacts 120 are arranged in pairs configured to convey differential signals. The header ground shields 122 peripherally surround a corresponding pair of the header signal contacts 120.

The first connector assembly 104 includes a first circuit board 130 and a first receptacle assembly 132 coupled to the first circuit board 130. The first receptacle assembly 132 is configured to be coupled to the first header assembly 116. The first receptacle assembly 132 includes a receptacle housing 138 that holds a plurality of contact modules 140. The contact modules 140 are held in a stacked configuration generally parallel to one another. The contact modules 140 hold a plurality of receptacle signal contacts (not shown) that are electrically connected to the first circuit board 130 and define signal paths through the first receptacle assembly 132. Optionally, the receptacle signal contacts may be arranged in pairs carrying differential signals.

The second connector assembly 106 includes a second circuit board 150 and a second receptacle assembly 152 coupled to the second circuit board 150. The second receptacle assembly 152 is configured to be coupled to the second header assembly 118. The second receptacle assembly 152 has a header interface 154 configured to be mated with the second header assembly 118. The second receptacle assembly 152 has a board interface 156 configured to be mated with the second circuit board 150. In an exemplary embodiment, the board interface 156 is oriented perpendicular with respect to the header interface 154. When the second receptacle assembly 152 is coupled to the second header assembly 118, the second circuit board 150 is oriented perpendicular with respect to the midplane circuit board 110. The second circuit board 150 is oriented perpendicular to the first circuit board 130.

The second receptacle assembly 152 includes a receptacle housing 158 that holds a plurality of contact modules 160. The contact modules 160 are held in a stacked configuration generally parallel to one another. The contact modules 160 hold a plurality of receptacle signal contacts 162 (shown in FIG. 2) that are electrically connected to the second circuit board 150 and define signal paths through the second receptacle assembly 152. The receptacle signal contacts 162 are configured to be electrically connected to the header signal contacts 120 of the second header assembly 118. In an exemplary embodiment, the contact modules 160 provide electrical shielding for the receptacle signal contacts 162. Optionally, the receptacle signal contacts 162 may be arranged in pairs carrying differential signals. Alternatively, the receptacle signal contacts may be single-ended as opposed to differential pairs. In an exemplary embodiment, the contact modules 160 generally provide 360° shielding for each pair of receptacle signal contacts 162 along substantially the entire length of the receptacle signal contacts 162 between the board interface 156 and the header interface 154. The shield structure of the contact modules 160 that provides the electrical shielding for the pairs of receptacle signal contacts 162 is electrically connected to the header ground shields 122 of the second header assembly 118 and is electrically connected to a ground plane of the second circuit board 150.

In the illustrated embodiment, the first circuit board 130 is oriented generally horizontally. The contact modules 140 of the first receptacle assembly 132 are orientated generally vertically. The second circuit board 150 is oriented generally vertically. The contact modules 160 of the second receptacle assembly 152 are oriented generally horizontally. The first connector assembly 104 and the second connector assembly 106 have an orthogonal orientation with respect to one another. The signal contacts within each differential pair, including the receptacle signal contacts of the first receptacle assembly 132, the receptacle signal contacts 162 of the second receptacle assembly 152, and the header signal contacts 120, are all oriented generally horizontally. The contact modules 140 and/or 160 may be configured to be terminated to cables rather than circuit boards, with conductors of the cables terminated to corresponding conductors of the contact modules 140, and/or 160.

Figure 2:
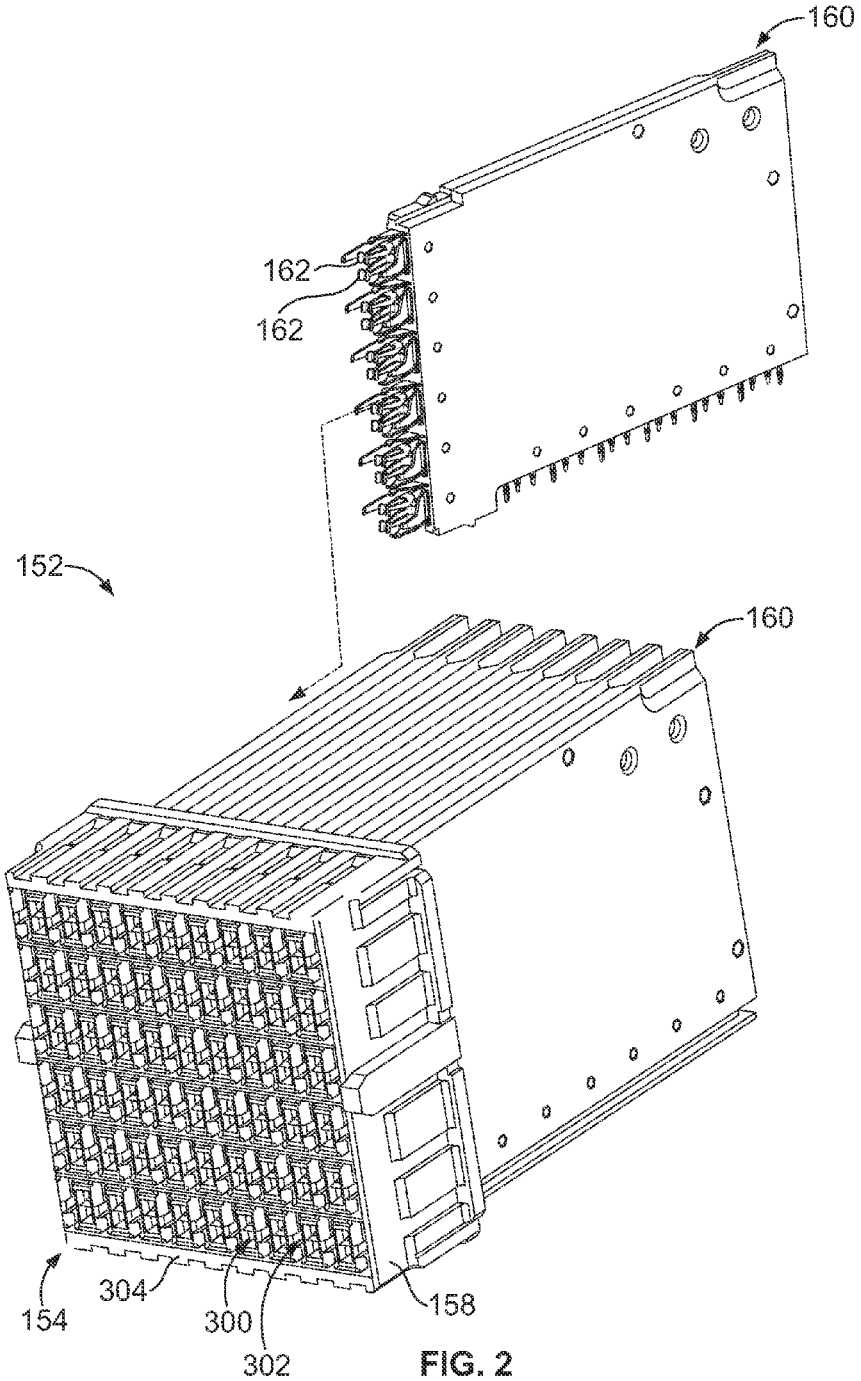
FIG. 2 is a front perspective view of a receptacle assembly formed in accordance with an exemplary embodiment.

FIG. 2 is a front perspective view of the second receptacle assembly 152 showing one of the contact modules 160 poised for loading into the receptacle housing 158. The receptacle housing 158 includes a plurality of signal contact openings 300 and a plurality of ground contacts openings 302 at a mating end 304 of the receptacle housing 158. The mating end 304 defines the header interface 154 of the second receptacle assembly 152. The contact modules 160 are coupled to the receptacle housing 158 such that the receptacle signal contacts 162 are received in corresponding signal contact openings 300 and the ground contact openings 302 receive corresponding header ground shields 122 (shown in FIG. 1) and grounding members, such as grounding beams of the contact modules 160.

Figure 3:
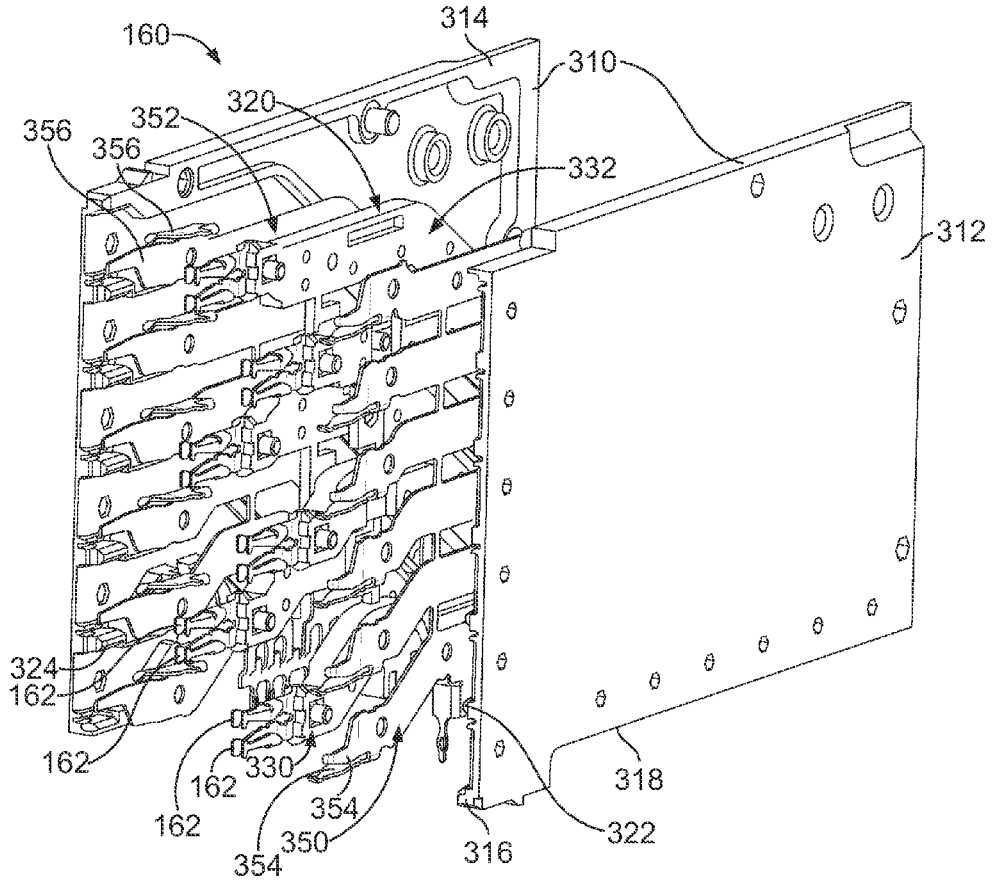
FIG. 3 is an exploded view of a contact module of the receptacle assembly.

FIG. 3 is an exploded view of the contact module 160. The contact module 160 includes a conductive holder 310, which in the illustrated embodiment includes a first holder member 312 and a second holder member 314 that are coupled together to form the holder 310. The conductive holder 310 has a mating end 316 and a mounting end 318.

The holder members 312, 314 are fabricated from a conductive material. For example, the holder members 312, 314 may be die cast from a metal material. Alternatively, the holder members 312, 314 may be stamped and formed or may be fabricated from a plastic material that has been metalized or coated with a metallic layer. By having the holder members 312, 314 fabricated from a conductive material, the holder members 312, 314 may provide electrical shielding for the second receptacle assembly 152. When the holder members 312, 314 are coupled together, the holder members 312, 314 define at least a portion of a shield structure to provide electrical shielding for the receptacle signal contacts 162. The conductive holder 310 may be manufactured from a single piece rather than the two holder members 312, 314. In other embodiments, the holder 310 may not be conductive, but rather may rely on separate shields or may be unshielded.

The conductive holder 310 holds a frame assembly 320, which includes the receptacle signal contacts 162. The holder members 312, 314 provide shielding around the frame assembly 320 and receptacle signal contacts 162. The holder members 312, 314 include tabs 322, 324 that extend inward toward one another to extend into the frame assembly 320. The tabs 322, 324 define at least a portion of a shield structure that provides electrical shielding around the receptacle signal contacts 162. The tabs 322, 324 are configured to extend into the frame assembly 320 such that the tabs 322, 324 are positioned between pairs of the receptacle signal contacts 162 to provide shielding between the corresponding pairs of the receptacle signal contacts 162.

The frame assembly 320 includes a first frame 330 and a second frame 332 that surround corresponding receptacle signal contacts 162. Optionally, the first frame 330 may be manufactured from a dielectric material overmolded over the corresponding receptacle signal contacts 162. The second frame 332 may be manufactured from a dielectric material overmolded over the corresponding receptacle signal contacts 162. The first and second frames 330, 332 are coupled together to form the frame assembly 320. In alternative embodiments, rather than having the two frames 330, 332, the frame assembly 320 may include only a single frame or may include more than two frames.

In an exemplary embodiment, the receptacle signal contacts 162 of the first frame 330 form part of a common leadframe 360 (shown in FIG. 4) defining the receptacle signal contacts 162 that is then overmolded with dielectric material during an overmolding process. The receptacle signal contacts 162 of the second frame 332 form part of a common leadframe (not shown but similar to the leadframe 360), separate from the leadframe of the first frame 330, that is separately overmolded to encase the corresponding receptacle signal contacts 162. Other manufacturing processes may be utilized to form the dielectric frames 330, 332 other than overmolding leadframes. In an exemplary embodiment, during the overmolding process, pairs of receptacle signal contacts 162 are held and supported by metal inserts that are part of the mold or are inserted into the mold prior to overmolding. The metal inserts hold the lateral positions of the receptacle signal contacts 162 relative to one another during the overmolding process, such as to resist movement of the receptacle signal contacts 162 by the injection forces of the dielectric material.

The holder members 312, 314 provide electrical shielding between and around respective pairs of the receptacle signal contacts 162. The holder members 312, 314 provide shielding from electromagnetic interference (EMI) and/or radio frequency interference (RFI). The holder members 312, 314 may provide shielding from other types of interference as well. The holder members 312, 314 prevent crosstalk between different pairs of receptacle signal contacts 162. The holder members 312, 314 provide electrical shielding around the outside of the first and second frames 330, 332, and thus around the outside of all of the receptacle signal contacts 162, as well as between the receptacle signal contacts 162, such as between pairs of receptacle signal contacts 162 separated by the tabs 322, 324. The holder members 312, 314 control electrical characteristics, such as impedance control, crosstalk control, and the like, of the receptacle signal contacts 162. The holder members 312, 314 provide shielding for the receptacle signal contacts 162 from adjacent contact modules.

In an exemplary embodiment, the contact module 160 includes a first ground shield 350 and a second ground shield 352 that provide shielding for the receptacle signal contacts 162. The ground shields 350, 352 make ground terminations to the header ground shields 122 (shown in FIG. 1) and the second circuit board 150 (shown in FIG. 1). In an exemplary embodiment, the ground shields 350, 352 are internal ground shields positioned within the conductive holder 310. The ground shields 350, 352 are inlaid within the conductive holder 310. For example, the first ground shield 350 is laid in the first holder member 312 and positioned between the first holder member 312 and the frame assembly 320. The second ground shield 352 is laid in the second holder member 314 and positioned between the second holder member 314 and the frame assembly 320.

The first ground shield 350 includes grounding beams 354 extending from a front thereof. The second ground shield 352 includes grounding beams 356 extending from a front thereof. The grounding beams 354, 356 extend along different sides of the receptacle signal contacts 162 to provide electrical shielding and electrical grounding. The grounding beams 354, 356 are configured to engage and be electrically connected to the header ground shields 122 (shown in FIG. 1) when the second receptacle assembly 152 is coupled to the second header assembly 118. The grounding beams 354, 356 are deflectable.

Figure 4:
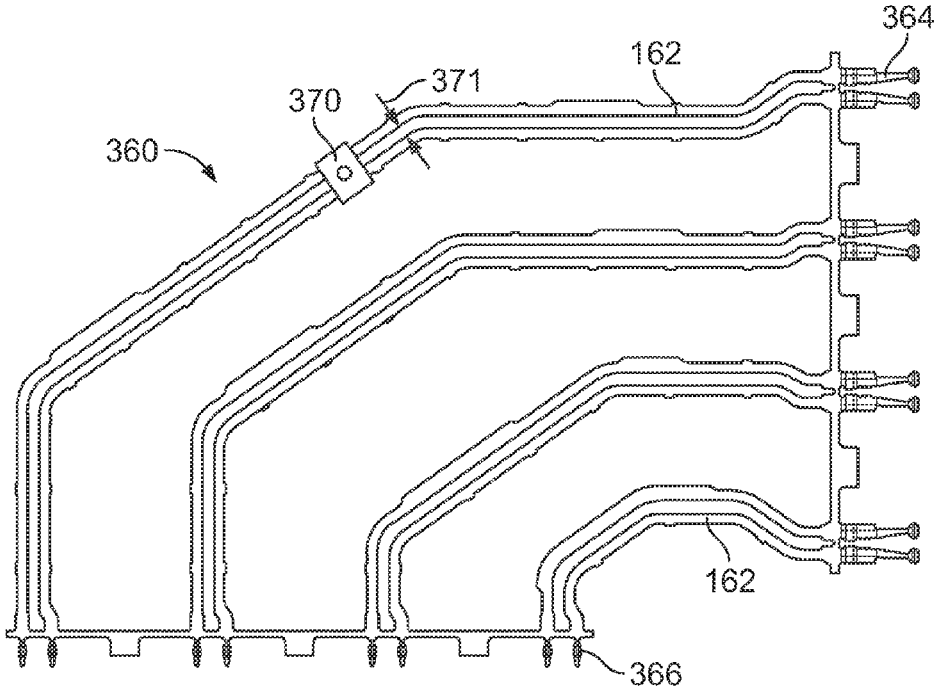
FIG. 4 illustrates a leadframe of the contact module.

FIG. 4 illustrates a leadframe 360 of the first frame 330. The receptacle signal contacts 162 are formed as part of the leadframe 360. The leadframe 360 is a stamped and formed structure and is initially held together by a carrier with connecting portions between each of the conductors defining the receptacle signal contacts 162. The carrier is later removed after the receptacle signal contacts 162 are held by the frame members 400 (shown in FIG. 6).

As illustrated in FIG. 4, the leadframe 360 is generally planar and defines a leadframe plane. Mating and mounting portions 364, 366 of the receptacle signal contacts 162 are integrally formed with the conductors of the leadframe 360. The conductors extend along predetermined paths between each mating portion 364 and corresponding mounting portion 366. The receptacle signal contacts 162 have a lateral spacing defined between adjacent receptacle signal contacts, such lateral spacing may vary along the length of the contacts or between different contacts. The mating portions 364 are configured to be mated with and electrically connected to corresponding header signal contacts 120 (shown in FIG. 1). The mounting portions 366 are configured to be electrically connected to the second circuit board 150 (shown in FIG. 1). For example, the mounting portions 366 may include compliant pins that extend into conductive vias in the second circuit board 150.

A removable insert 370 is illustrated in FIG. 4. The removable insert 370 is used to hold corresponding receptacle signals contacts 162, such as a differential pair of the receptacle signal contacts 162. The removable insert 370 maintains a predetermined spacing 371 between the differential pair of receptacle signals contacts 162, such as when the dielectric material is overmolded over the leadframe 360. After overmolding, the removable insert 370 is removed from the first frame 330 (shown in FIG. 3) leaving a window or space that is devoid of the dielectric material. The removable insert 370 may be a separate piece held in the mold or may be part of the mold that is removed from the contact module after the molding process. As described in further detail below, a dielectric insert or plug fills the window to maintain signal integrity of the receptacle signal contacts 162. For example, the dielectric insert may reduce the amount of the conductors that are exposed to air.

The removable insert 370 holds the nominal positions of the differential pair of receptacle signal contacts 162 relative to each other during overmolding. For example, the removable insert 370 stops one or both receptacle signal contacts 162 from moving toward or away from one another and/or from moving out of the plane of the leadframe 360. Any of the receptacle signal contacts 162 may be held by removable inserts 370 and any number of removable inserts 370 may be used as necessary to hold the receptacle signal contacts 162. For example, shorter lengths of the receptacle signal contacts 162 (e.g. the interior pairs of receptacle signal contacts 162) may not need removable inserts 370 as the receptacle signal contacts 162 may be sufficiently held by the carrier without significant movement thereof.

Figure 5:
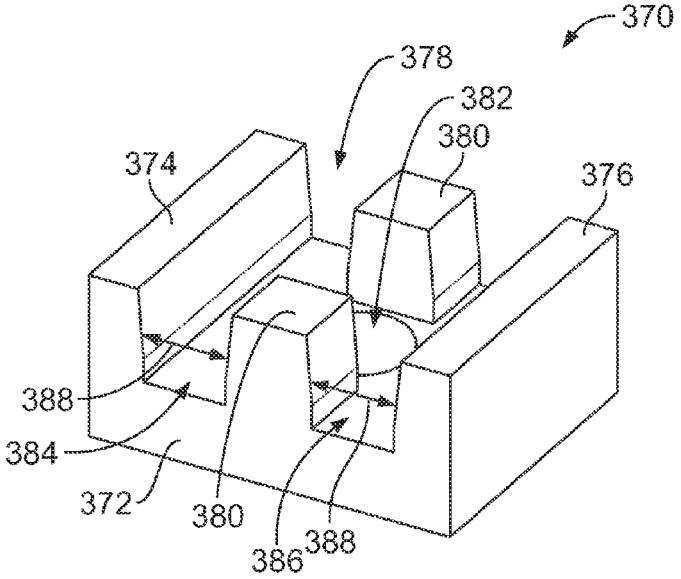
FIG. 5 is a perspective view of a removable insert for the contact module.

FIG. 5 is a perspective view of the removable insert 370. The removable insert 370 includes a main wall 372, end walls 374, 376 extending from the main wall 372 and forming a receiving space 378 therebetween, and fingers 380 extending from the main wall 372 in the receiving space 378. An opening 382 is formed in the main wall 372 between the fingers 380. First and second channels 384, 386 are formed between the fingers 380 and the corresponding end walls 374, 376. The first and second channels 384, 386 receive the receptacle signal contacts 162 (shown in FIG. 4). The fingers 380 and end walls 374, 376 hold the lateral positions of the receptacle signal contacts 162 relative to each other during the overmolding process. Widths 388 of the channels 384, 386 may be substantially equal to the widths of the receptacle signal contacts 162 to restrict lateral movement relative to the removable insert 370. The receiving space 378 is filled with dielectric material during overmolding of the frames 330, 332 (shown in FIG. 3). The removable insert 370 may have other shapes or features in alternative embodiments.

Figure 6:
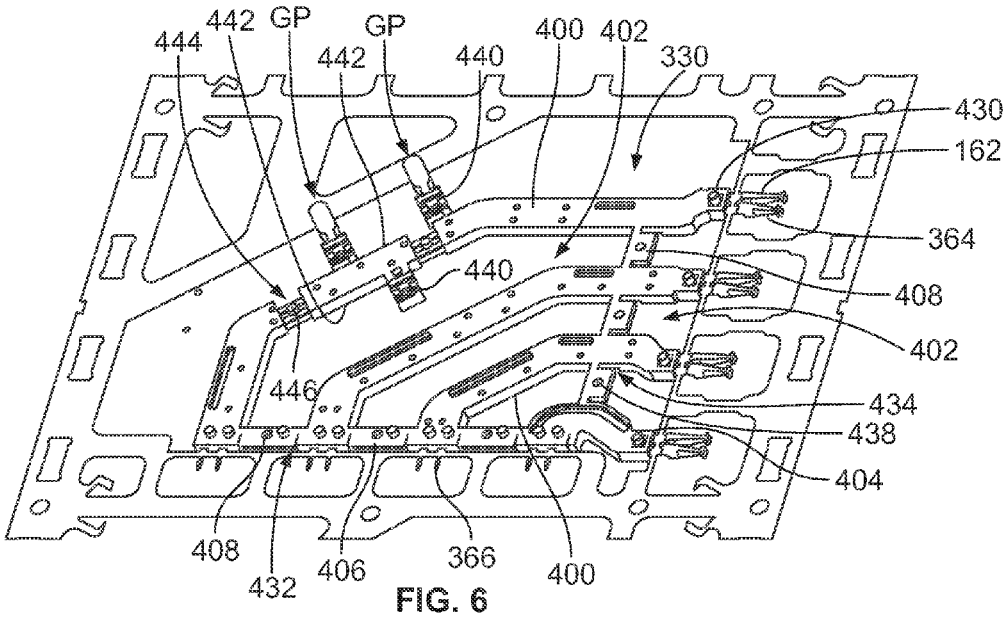
FIG. 6 is a side perspective view of a first frame of the contact module formed in accordance with an exemplary embodiment.

FIG. 6 is a side perspective view of the first frame 330 formed in accordance with an exemplary embodiment. The first frame 330 includes a plurality of frame members 400 each supporting different differential pairs of receptacle signal contacts 162. The frame members 400 are separated by gaps 402. Any number of frame members 400 may be provided. In the illustrated embodiment, three frame members 400 are used corresponding to three differential pairs of receptacle signal contacts 162 of the first frame 330.

The frame members 400 extend between a mating end 404 of the first frame 330 and a mounting end 406 of the first frame 330. In the illustrated embodiment, the mating end 404 is generally perpendicular with respect to the mounting end 406; however other orientations are possible in alternative embodiments. The mating portions 364 of the receptacle signal contacts 162 extend from the frame members 400 beyond the mating end 404 and the mounting portions 366 extend from the frame members 400 beyond the mounting end 406 for electrical termination to other components such as the second header assembly 118 and the second circuit board 150 (both shown in FIG. 1), respectively.

The frame members 400 are connected by bridges 408 that span the gaps 402. The bridges 408 position the frame members 400 with respect to one another. In an exemplary embodiment, the bridges 408 are located proximate to the mating end 404 and the mounting end 406 of the first frame 330. The bridges 408 are co-molded with the frame members 400. The bridges 408 define flow paths for the dielectric material of the frame members 400 during the molding (e.g. injection molding) process. For example, the dielectric material may be injected into the mold at gating points (generally identified at points GP) which are located along the outer-most frame member 400 and the dielectric material flows through the bridges into the interior frame members 400 to mold the entire frame 330. Any number of gating points may be provided. The gating points GP may be located on interior frame members 400 in addition to, or in lieu of, the outer frame member 400. The force from the injection of the dielectric material at the gating points may cause pressure and shifting of the receptacle signal contacts 162 of the leadframe 360 (shown in FIG. 4). The removable inserts 370 are used to hold the receptacle signal contacts 162 during the injection process to resist shifting caused by the force of the dielectric material being injected into the mold.

During the overmolding process, a majority of the leadframe 360 is encased in a dielectric material which forms the frame members 400. The mating portions 364 extend from the mating end 404 along an edge of the frame members 400 (e.g. a front edge), and the mounting portions 366 extend from the mounting end 406 along another edge of the frame members 400 (e.g. a side edge).

The receptacle signal contacts 162 are arranged in pairs. One of the receptacle signal contacts 162 in each pair defines a radially inner receptacle signal contact (measured from the intersection between the mating and mounting ends of the contact module 160), while the other receptacle signal contact 162 in each pair defines a radially outer receptacle signal contact. The inner and outer receptacle signal contacts 162 have different lengths between the mating portions 364 and the mounting portions 366. In an exemplary embodiment, the radially outer receptacle signal contacts 162 are exposed to air through the frame members 400 for electrical compensation, such as to reduce electrical skew.

The frame members 400 include locating posts 430 extending therefrom. The locating posts 430 are configured to be received in corresponding openings in the conductive holder 310 (shown in FIG. 3) to locate and/or secure the first frame 330 within the conductive holder 310. In an exemplary embodiment, the bridges 408 near the mounting end 406 include locating channels 432 formed therethrough. The locating channels 432 receive tabs or other features of the conductive holder 310 to position and or secure the first frame 330 with respect to the conductive holder 310.

In an exemplary embodiment, at least some of the frame members 400 include troughs 434. The troughs 434 are recessed areas that are configured to receive portions of the second frame 332 (shown in FIG. 3). Optionally, the troughs 434 may be generally aligned with the bridges 408. Optionally, at least one frame coupling member (not shown) is located within each trough 434. The frame coupling member is configured to extend into the second frame 332 to position the first frame 330 with respect to the second frame 332.

In an exemplary embodiment, the bridges 408 include coupling members 438 that interact with corresponding coupling members of the second frame 332 to secure the first frame 330 with respect to the second frame 332. In the illustrated embodiment, the coupling members 438 constitute openings extending through the bridges 408. The openings receive posts or other types of coupling members therein. Other types of coupling members 438 may be provided on the bridges 408, such as posts, slots, latches, or other types of fasteners.

In an exemplary embodiment, the first frame 330 includes dielectric inserts 440 extending from one or more of the frame members 400. The dielectric inserts 440 are integral with the frame members 400. The dielectric inserts 440 are co-molded with the frame members 400. The dielectric inserts 440 are molded at the same time as the frame members 400 and extend outward from corresponding edges 442 of the frame members 400. The dielectric inserts 440 are configured to fill the windows or voids left in the second frame 332 (shown in FIG. 3) by the removable inserts 370 when the first frame 330 is coupled to the second frame 332. The dielectric inserts 440 have a complementary shape to the removable insert 370. The dielectric inserts 440 have a complementary shape to the window or void left in the second frame 332 by the removable insert 370. In alternative embodiments, the dielectric inserts 440 may be separate from the first and second frames 330, 332, such as separate pieces that are plugged into the frames 330, 332. In other alternative embodiments, the dielectric inserts 440 may be formed with the same frame 330 or 332 and pivotably or hingedly attached thereto, such as at a living hinge that may be folded over into position.

The frame members 400 include voids or windows 444 left behind when the removable inserts 370 (shown in FIG. 5) are removed from the first frame 330 and the mold used to form the frame members 400. In an alternative embodiment, the removable insert 370 may form part of the mold used to form the first frame 330, such removable insert 370 being removable from the formed frame members 400 but not from the mold. Because the receptacle signal contacts 162 are held against the removable inserts 370 (e.g. in the channels 384, 386 (shown in FIG. 5)), the windows 444 expose the receptacle signal contacts 162. A post 446 remains in each window 444 after being formed in the opening 382 (shown in FIG. 5) in the removable insert 370. The post 446 is used to connect the first frame 330 to the second frame 332 during assembly.

Figure 7:
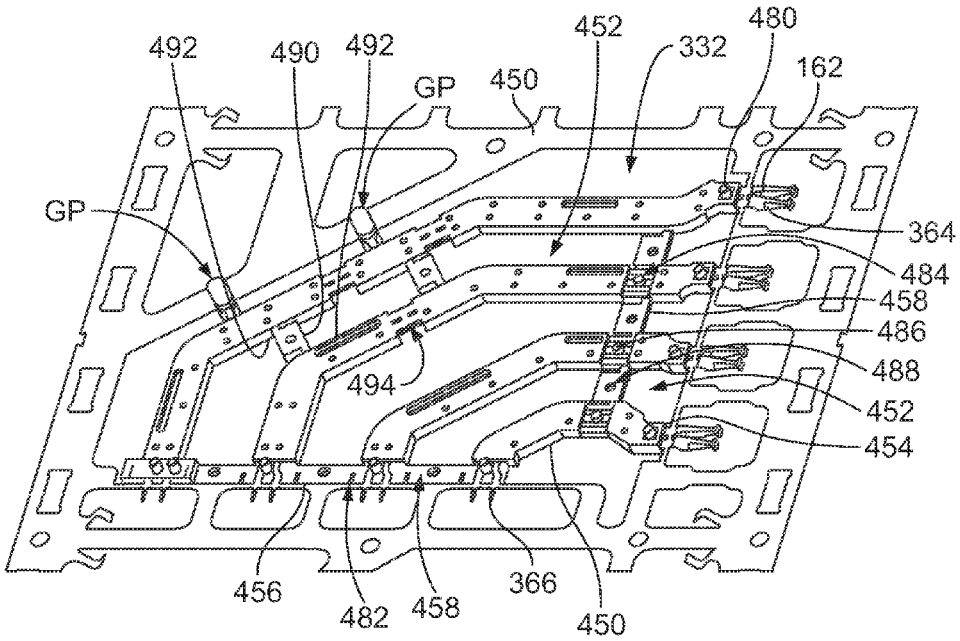
FIG. 7 is a side perspective view of a second frame of the contact module formed in accordance with an exemplary embodiment.

FIG. 7 is a side perspective view of the second frame 332 formed in accordance with an exemplary embodiment. The second frame 332 includes a plurality of frame members 450 each supporting different differential pairs of receptacle signal contacts 162. The frame members 450 are separated by gaps 452. Any number of frame members 450 may be provided. In the illustrated embodiment, four frame members 450 are used corresponding to four differential pairs of receptacle signal contacts 162 of the second frame 332.

The frame members 450 extend between a mating end 454 of the second frame 332 and a mounting end 456 of the second frame 332. In the illustrated embodiment, the mating end 454 is generally perpendicular with respect to the mounting end 456; however other orientations are possible in alternative embodiments. The receptacle signal contacts 162 extend from the frame members 450 beyond the mating end 454 and beyond the mounting end 456 for electrical termination to other components, such as the second header assembly 118 and the second circuit board 150 (both shown in FIG. 1).

The frame members 450 are connected by bridges 458 that span the gaps 452. The bridges 458 position the frame members 450 with respect to one another. In an exemplary embodiment, the bridges 458 are located proximate to the mating end 454 and the mounting end 456 of the second frame 332. The bridges 458 are co-molded with the frame members 450. The bridges 458 define flow paths for the dielectric material of the frame members 450 during the molding (e.g. injection molding) process. For example, the dielectric material may be injected into the mold at gating points (generally identified at points GP) which are located along the outer-most frame member 450 and the dielectric material flows through the bridges 458 into the interior frame members 450 to mold the entire frame 332. Any number of gating points may be provided. The gating points GP may be located on interior frame members 450 in addition to, or in lieu of, the outer frame member 450. The force from the injection of the dielectric material at the gating points may cause pressure and shifting of the receptacle signal contacts 162 of the leadframe. The removable inserts 370 (shown in FIG. 5) are used to hold the receptacle signal contacts 162 during the injection process to resist shifting caused by the force of the dielectric material being injected into the mold.

In an exemplary embodiment, the second frame 332 includes a leadframe, similar to the leadframe 360 (shown in FIG. 4), where like components are identified by like reference numerals. The frame members 450 are overmolded over the receptacle signal contacts 162 defined by the leadframe. The receptacle signal contacts 162 are arranged in pairs. The mating portions 364 extend from the mating end 454 along an edge of the frame members 450 (e.g. a front edge), and the mounting portions 366 extend from the mounting end 456 along another edge of the frame members 450 (e.g. a side edge).

The frame members 450 include locating posts 480 extending therefrom. The locating posts 480 are configured to be received in corresponding openings in the conductive holder 310 (shown in FIG. 3) to locate and/or secure the second frame 332 within the conductive holder 310. In an exemplary embodiment, the bridges 458 near the mounting end 456 include locating channels 482 formed therethrough. The locating channels 482 receive tabs or other features of the conductive holder 310 to position and or secure the second frame 332 with respect to the conductive holder 310.

In an exemplary embodiment, at least some of the frame members 450 include troughs 484. The troughs 484 are recessed areas that are configured to receive portions of the first frame 330 (shown in FIG. 6). Optionally, the troughs 484 may be generally aligned with the bridges 458. Optionally, at least one frame coupling member 486 is located within each trough 484. The frame coupling member 486 is configured to extend into the first frame 330 to position the first frame 330 with respect to the second frame 332. Optionally, the frame coupling members 486 may also be used as locating posts, such as when the frame coupling members 486 are longer and are configured to extend into the conductive holder 310 in addition to extending through the coupling member 438 (shown in FIG. 6) of the first frame 330.

In an exemplary embodiment, the bridges 458 include coupling members 488 that interact with corresponding coupling members of the first frame 330 to secure the first frame 330 with respect to the second frame 332. In the illustrated embodiment, the coupling members 488 constitute openings extending through the bridges 458. The openings receive posts or other types of coupling members therein. Other types of coupling members 488 may be provided on the bridges 458, such as posts, slots, latches, or other types of fasteners.

In an exemplary embodiment, the second frame 332 includes dielectric inserts 490 extending from one or more of the frame members 450. The dielectric inserts 490 are integral with the frame members 450. The dielectric inserts 490 are co-molded with the frame members 450. The dielectric inserts 490 are molded at the same time as the frame members 450 and extend outward from corresponding edges 492 of the frame members 450. The dielectric inserts 490 are configured to fill the voids or windows 444 left in the first frame 332 (shown in FIG. 6) by the removable inserts 370 when the first frame 330 is coupled to the second frame 332. The dielectric inserts 490 have a complementary shape to the removable insert 370. The dielectric inserts 490 have a complementary shape to the void or window 444 left in the second frame 332 by the removable insert 370.

The frame members 450 include voids or windows 494 left behind when the removable inserts 370 (shown in FIG. 5) are removed from the second frame 332 and mold used to form the frame members 450. In an alternative embodiment, the removable insert 370 may form part of the mold used to form the second frame 332, such removable insert 370 being removable from the formed frame members 450 but not from the mold. Because the receptacle signal contacts 162 are held against the removable inserts 370 (e.g. in the channels 384, 386 (shown in FIG. 5)), the windows 494 expose the receptacle signal contacts 162. A post (not shown) remains in each window 494 after being formed in the opening 382 (shown in FIG. 5) in the removable insert 370. The post is used to connect the first frame 330 to the second frame 332 during assembly.

Figure 8:
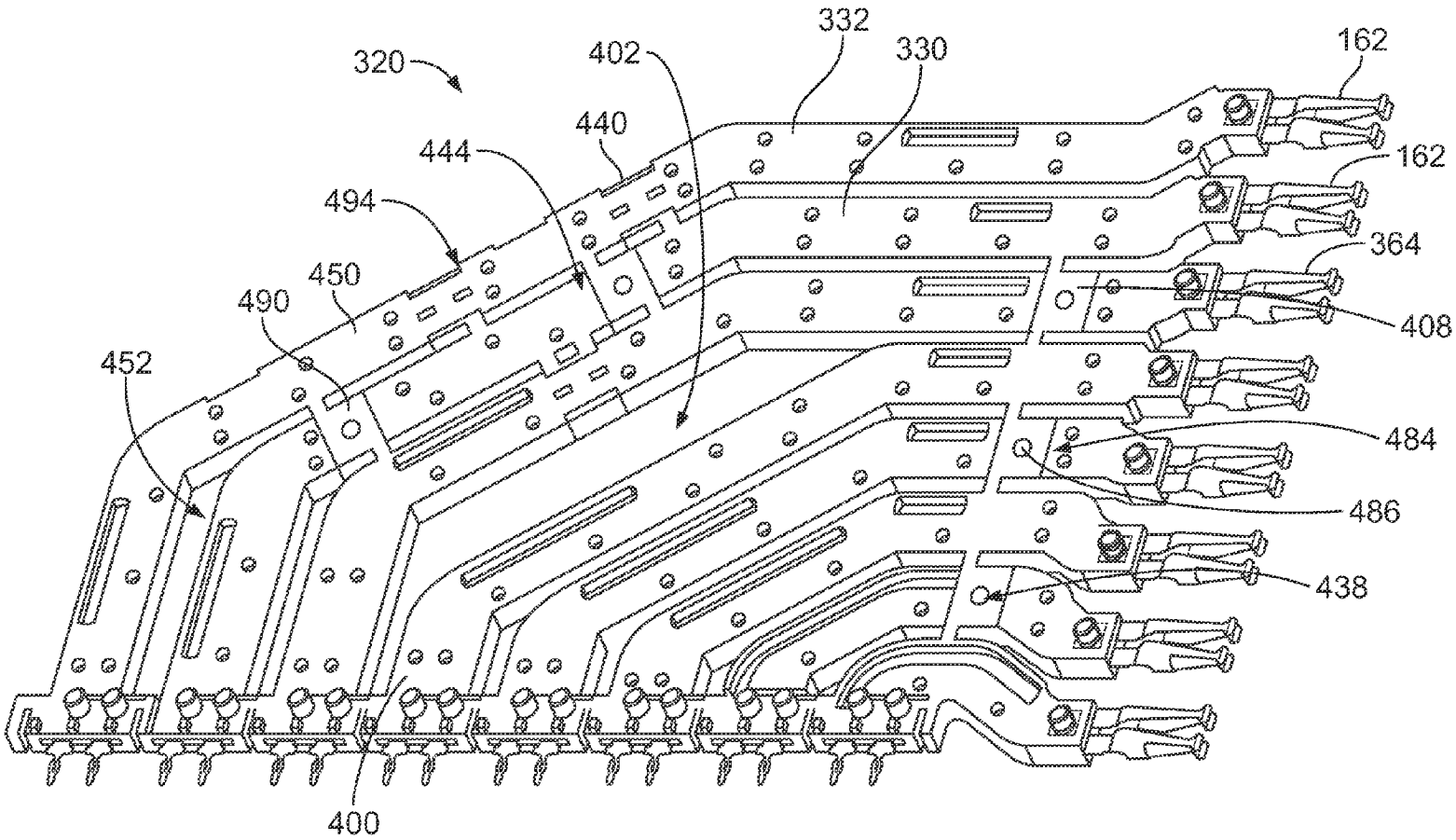
FIG. 8 is a side perspective view of a frame assembly of the contact module.

FIG. 8 is a side perspective view of the frame assembly 320 showing the first frame 330 and the second frame 332 coupled together. The first and second frames 330, 332 are internested such that the frame members 400 of the first frame 330 are received in corresponding gaps 452 of the second frame 332 between frame members 450 of the second frame 332. The first and second frames 330, 332 are internested such that the frame members 450 of the second frame 332 are received in corresponding gaps 402 of the first frame 330 between frame members 400 of the first frame 330. The first and second frames 330, 332 are internested such that the frame members 400, 450 of the first and second frames 330, 332 are generally coplanar. The frame members 400, 450 are arranged in an alternating sequence (e.g. frame member 400, frame member 450, frame member 400, frame member 450). Internesting the frame members 400, 450 positions the differential pairs of receptacle signal contacts 162 of the first frame 330 interspersed between corresponding differential pairs of receptacle signal contacts 162 of the second frame 332, and vice versa.

When the first and second frames 330, 332 are coupled together, the bridges 408 span across and engage corresponding frame members 450 of the second frame 332. For example, the bridges 408 are received in corresponding troughs 484. Similarly, the bridges 458 (shown in FIG. 7) of the second frame 332 span across and engage corresponding frame members 400 of the first frame 330. For example, the bridges 458 are received in corresponding troughs 434 (shown in FIG. 6) in the frame members 400. The coupling members 438 engage corresponding frame coupling members 486 to secure the first frame 330 with respect to the second frame 332.

When the first and second frames 330, 332 are coupled together, the dielectric inserts 440 of the first frame 330 are received in corresponding windows 494 of the second frame 332. The dielectric inserts 440 substantially fill the windows 494. The dielectric inserts 440 cover the receptacle signal contacts 162 to limit exposure of the receptacle signal contacts 162 to air, which has a different dielectric constant than the dielectric material and which would impact or degrade the signal integrity. The dielectric inserts 440 may compensate from air around the signal contacts 162. Covering of the receptacle signal contacts 162 maintains the signal integrity of the receptacle signal contacts 162. Similarly, when the first and second frames 330, 332 are coupled together, the dielectric inserts 490 of the second frame 332 are received in corresponding windows 444 of the first frame 330. The dielectric inserts 490 substantially fill the windows 444. The dielectric inserts 490 cover the receptacle signal contacts 162.

In an exemplary embodiment, the gaps 402, 452 are sufficiently wide to accommodate the corresponding frame members 450, 400. For example, a width of the gaps 402 is wider than a width of the frame members 450. Similarly, a width of the gaps 452 is wider than a width of the frame members 400. In an exemplary embodiment, slots are defined between the frame members 400, 450. Widths of the slots may vary depending on the widths of the gaps and the widths of the frame members 450, 400. In an exemplary embodiment, the slots are sized and shaped to receive the tabs 322, 324 (shown in FIG. 3) of the conductive holder 310 (shown in FIG. 3). Having the tabs 322, 324 in the slots provides electrical shielding between each of the differential pairs of receptacle signal contacts 162.

Having the first frame 330 manufactured separately from the second frame 332 allows adequate spacing between the receptacle signal contacts 162 for stamping and forming the mating portions 364 of the receptacle signal contacts 162. For example, a dimension of material that is required to form the mating portions 364 may be greater than the desired spacing. In order to have the tight spacing between the receptacle signal contacts 162, the two frames 330, 332 are separately manufactured and coupled together.

Figure 9:
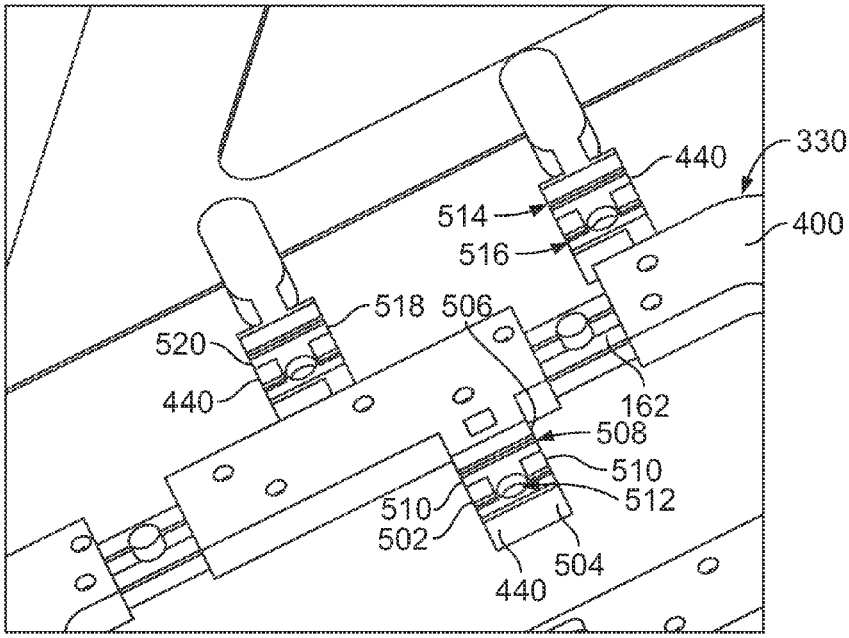
FIG. 9 is an enlarged view of a portion of the first frame showing a dielectric insert formed in accordance with an exemplary embodiment.

FIG. 9 is an enlarged view of a portion of the first frame 330, showing details of the dielectric inserts 440. Each of the dielectric inserts 440 includes a main wall 502, end walls 504, 506 extending from the main wall 502 and forming a receiving space 508 therebetween, and fingers 510 extending from the main wall 502 in the receiving space 508. The end walls 504, 506 are configured to extend along sides of the frame members 450 (shown in FIG. 7) in the windows 494 (shown in FIG. 7). The end wall 504 may be integral with the frame member 400.

An opening 512 is formed in the main wall 502 between the fingers 510. The opening 512 is configured to receive a corresponding post of the second frame 332 (shown in FIG. 7).

First and second channels 514, 516 are formed between the fingers 510 and the corresponding end walls 504, 506. The first and second channels 514, 516 receive the receptacle signal contacts 162 (shown in FIG. 7) of the second frame 332. The fingers 510 are positioned between the receptacle signal contacts 162 and are configured to be loaded through the frame members 450.

In an exemplary embodiment, the dielectric inserts 440 include angled side walls 518, 520 extending between the end walls 504, 506. The side walls 518, 520 are narrower at the top and wider at the bottom (or vice versa). The side walls 518, 520 define a wedge shaped piece configured to be plugged into the window 494 in the second frame 332. The angled side walls 518, 520 are aligned with the conductors of the second frame 332 when coupled thereto to provide improved coverage of the conductors, which may improve the signal integrity of the conductors.

The dielectric inserts 440 may have other shapes or features in alternative embodiments. The dielectric inserts 490 (shown in FIG. 7) may have similar shapes and features as the dielectric inserts 440.

Figure 10:
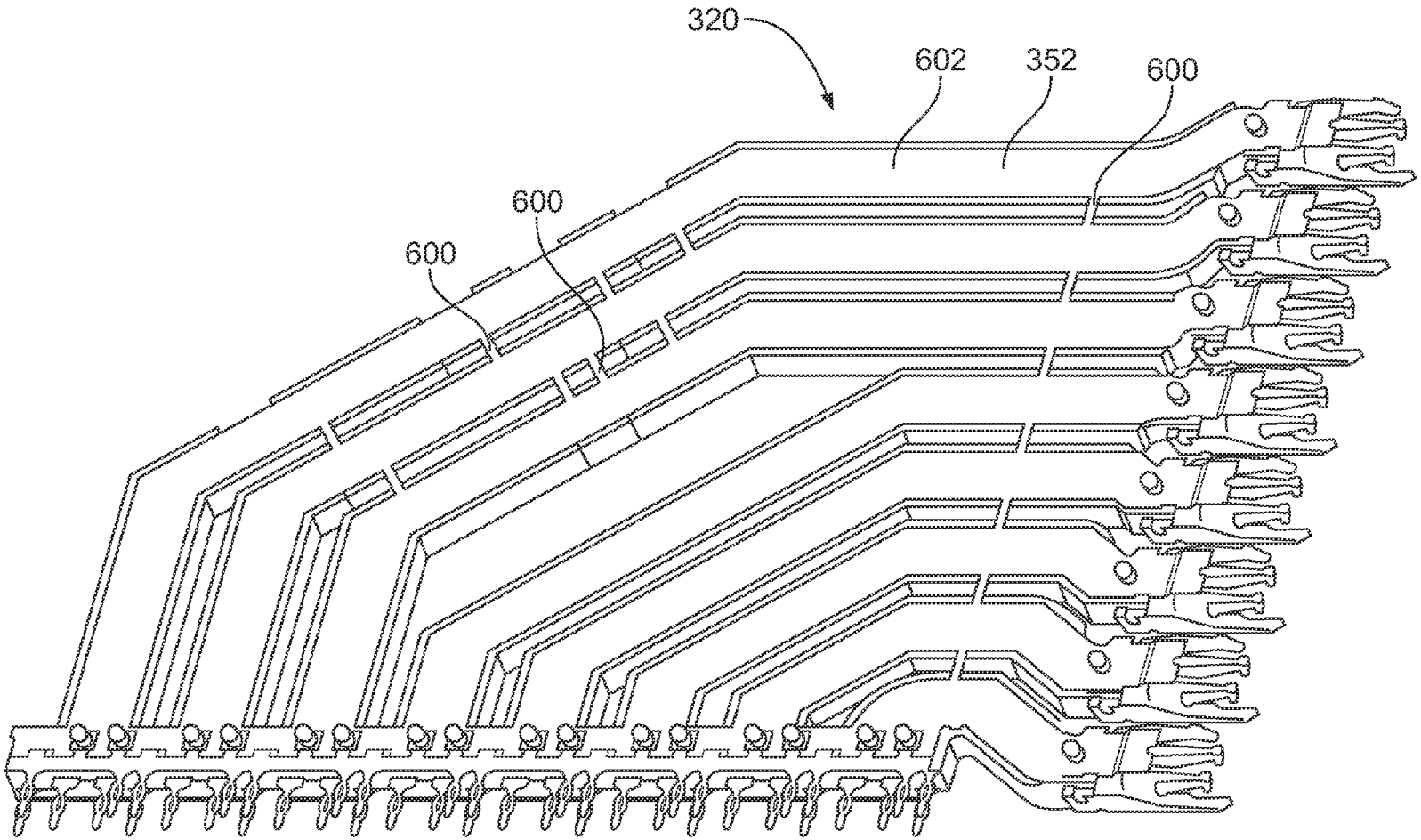
FIG. 10 illustrates the frame assembly with a ground shield coupled thereto.

FIG. 10 illustrates the frame assembly 320 with the second ground shield 352 coupled thereto. The ground shield 352 includes crossbars 600 extending between ground frames 602. The crossbars 600 span across the bridges 408, 458 (shown in FIGS. 6 and 7) and the dielectric inserts 440, 490 (shown in FIGS. 6 and 7). The crossbars 600 provide electrical shielding and/or impedance compensation in the areas of the bridges 408, 458 and the dielectric inserts 440, 490. Widths of the crossbars 600 may be selected to provide adequate electrical shielding.

Figure 11:
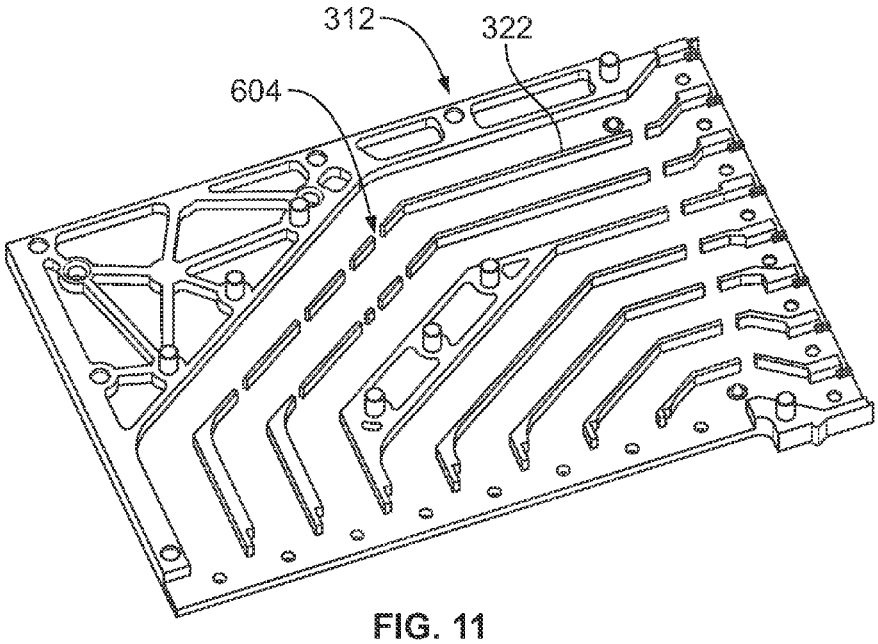
FIG. 11 illustrates a holder member formed in accordance with an exemplary embodiment.

FIG. 11 illustrates the first holder member 312. The tabs 322 are illustrated forming individual channels that receive corresponding frame members 400 (shown in FIG. 6). The tabs 322 include slots 604 in select locations. The slots 604 allow portions of the cross bars 600 (shown in FIG. 10), bridges 408, 458 (shown in FIGS. 6 and 7) and the dielectric inserts 440, 490 (shown in FIGS. 6 and 7) all to span between the channels. Optionally, the slots 604 may only be provided in one of the holder members 312 or 314 and not both holder members 312 and 314.

Figure 12:
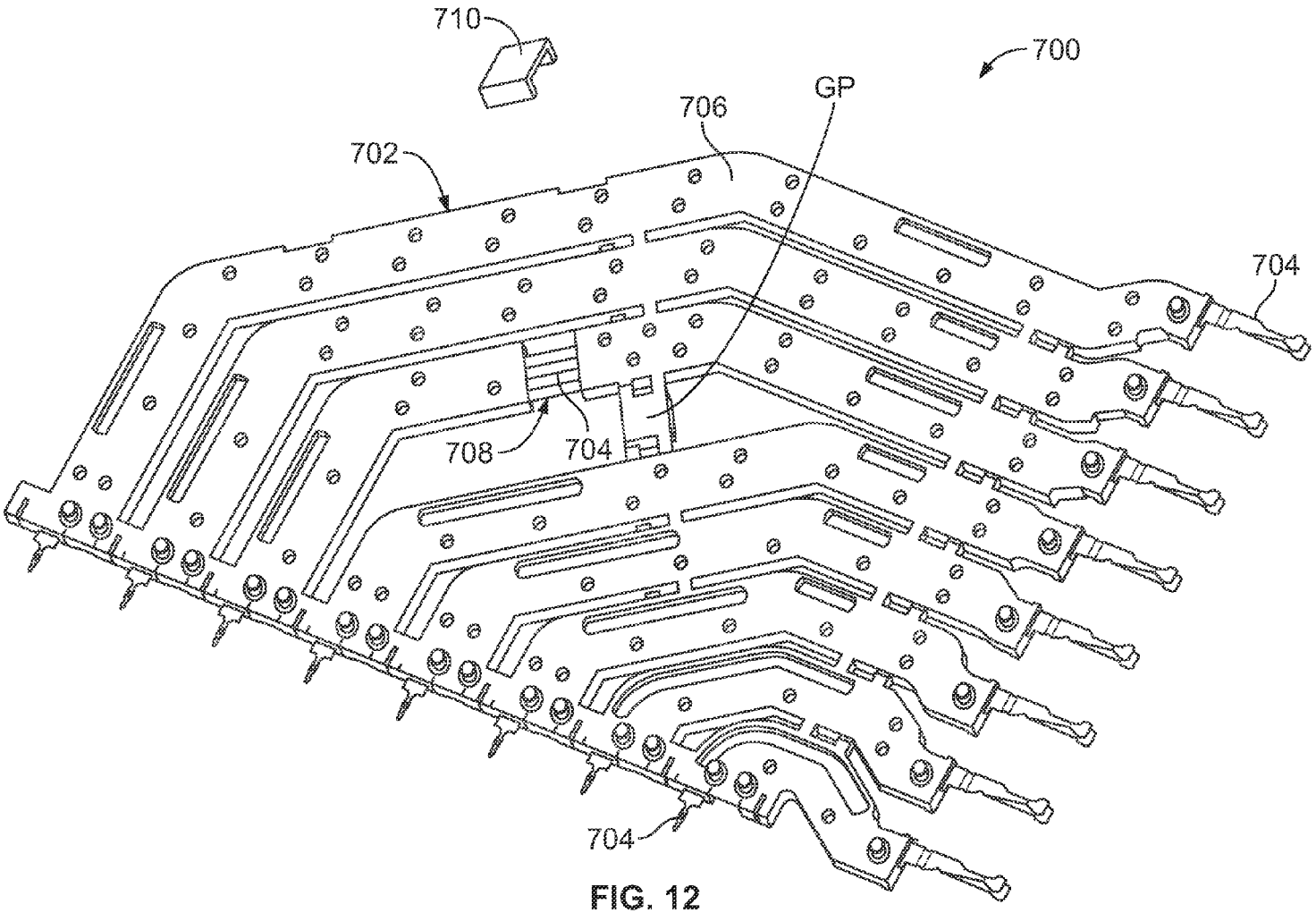
FIG. 12 illustrates a frame assembly formed in accordance with an exemplary embodiment.

FIG. 12 illustrates a frame assembly 700 formed in accordance with an exemplary embodiment. The frame assembly 700 is similar to the frame assembly 320 (shown in FIG. 3), however the frame assembly 700 includes a single frame 702 supporting single ended receptacle signal contacts 704, as opposed to differential pairs of contacts. The signal contacts 704 are overmolded with dielectric material that form frame members 706, with each frame member 706 holding an individual signal contact 704. A gating point (GP) is defined at an interior position of the frame 702.

In an exemplary embodiment, one of the signal contacts 704 closest to, and exterior of, the gating point is held by a removable insert (not shown) during overmolding, thus forming a window 708 around a portion of the signal contact 704 and frame member 706. A dielectric insert 710 is configured to be coupled to the frame 702 at the window 708. The dielectric insert 710 plugs the window to reduce effects of air exposure to the signal contact 704. Optionally, when multiple removable inserts are used to hold different signal contacts 704, thus forming multiple windows, multiple dielectric inserts 710 may be molded together, such as with bridges therebetween, to be coupled to the frame 702 as a single piece.

Figure 13:
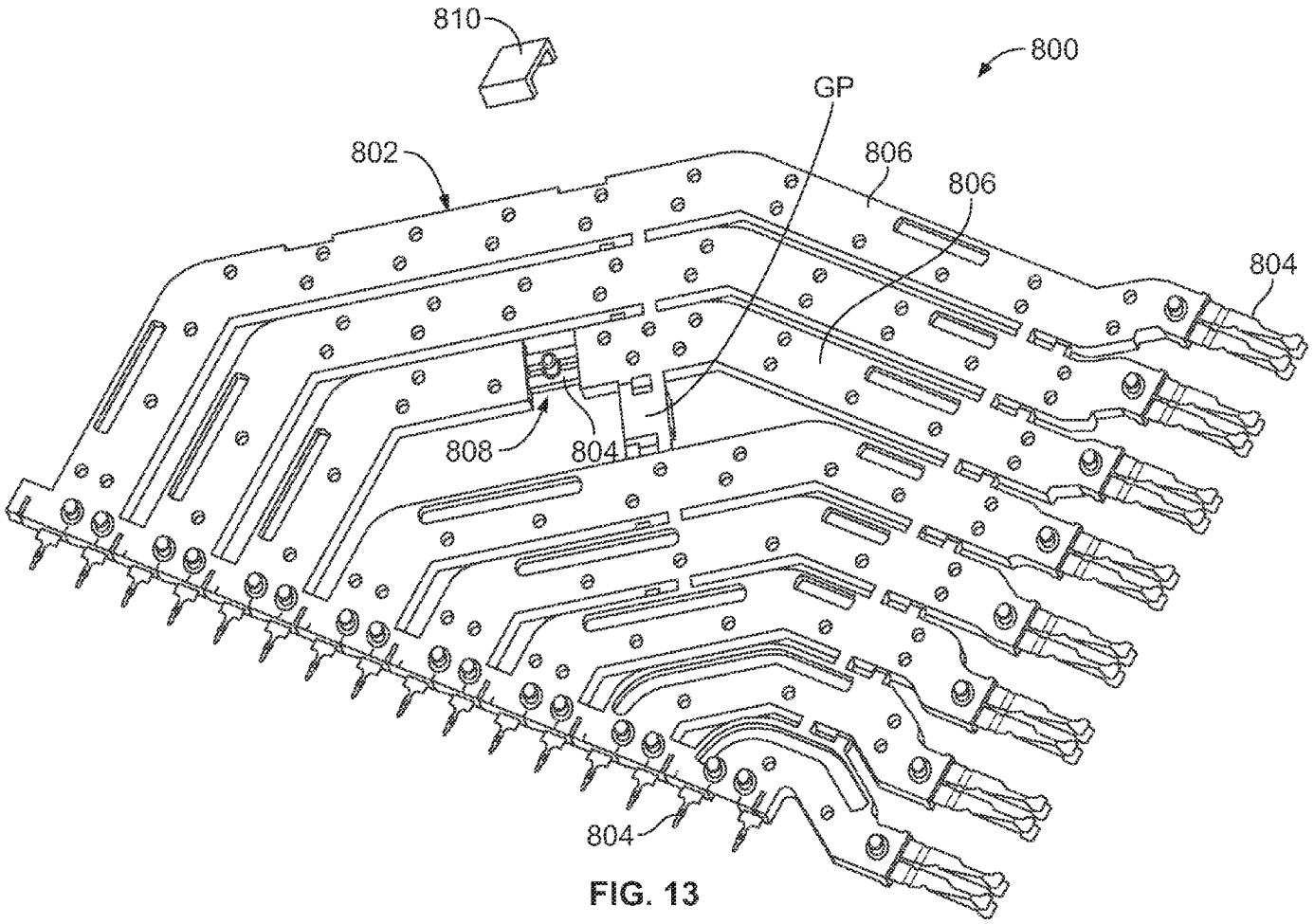
FIG. 13 illustrates a frame assembly formed in accordance with an exemplary embodiment.
Figure 14:
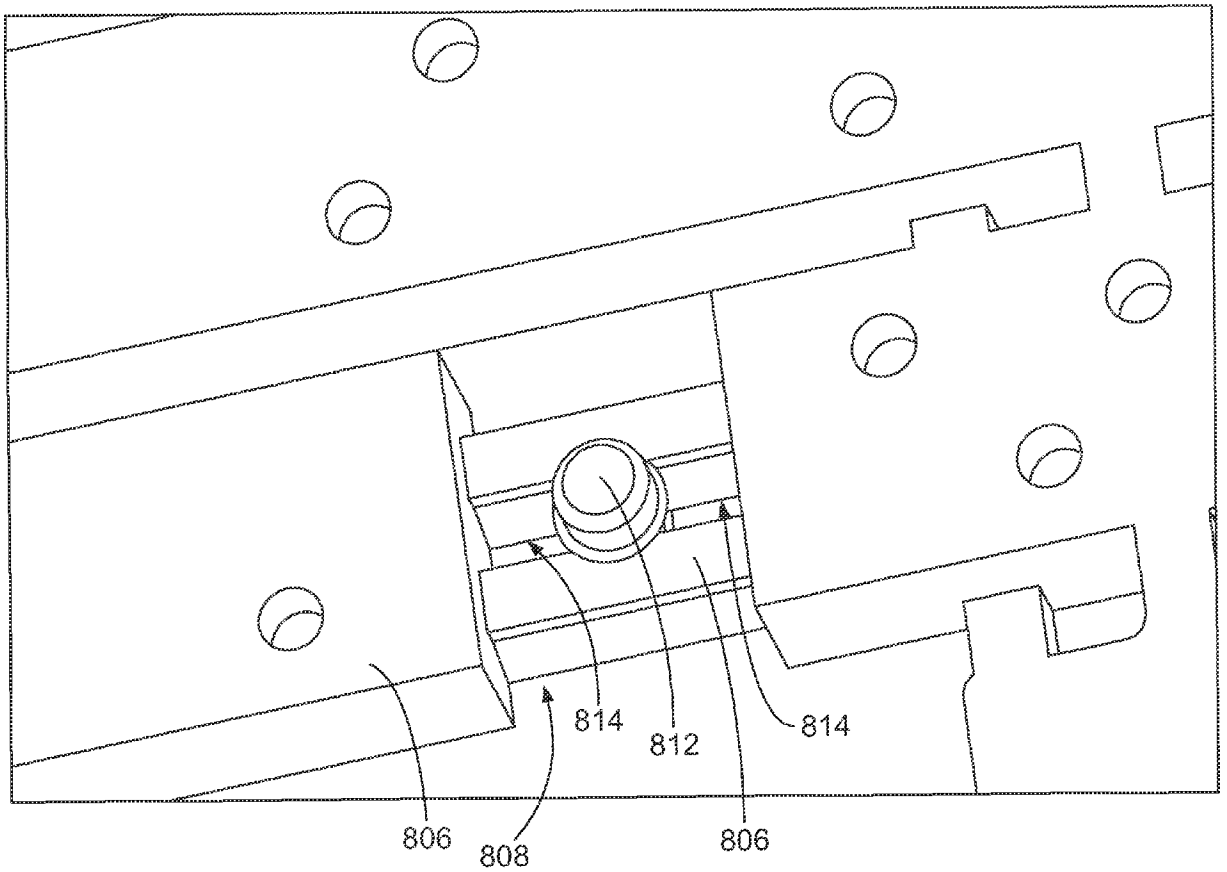
FIG. 14 is an enlarged view of a portion of the frame assembly.

FIG. 13 illustrates a frame assembly 800 formed in accordance with an exemplary embodiment. FIG. 14 is an enlarged view of a portion of the frame assembly 800. The frame assembly 800 is similar to the frame assembly 700 (shown in FIG. 12). Optionally, the frame assembly 800 may include a single frame 802 supporting differential pairs of receptacle signal contacts 804. Alternatively, the frame assembly 800 may include multiple frames that are internested, in a similar manner as the frame assembly 320 (shown in FIG. 3). The signal contacts 804 are overmolded with dielectric material that form frame members 806, with each frame member 806 holding a differential pair of signal contacts 804. A gating point (GP) is defined at an interior position of the frame 802.

In an exemplary embodiment, one or more pairs of the signal contacts 804, such as those closest to the gating point, is held by a removable insert (not shown) during overmolding, thus forming a window 808 around a portion of the signal contacts 804 and corresponding frame member 806. A dielectric insert 810 is configured to be coupled to the frame 802 at the window 808. The dielectric insert 810 plugs the window to reduce effects of air exposure to the signal contact 804.

A post 812 (shown in FIG. 14) is formed in the window 808 by the removable insert. The post 812 is used to connect the dielectric insert 810 to the 802. Openings 814 (shown in FIG. 14) are formed between the pair of signal contacts 804. Legs of the dielectric insert 810 are loaded into the openings 814 during assembly.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A contact module for a receptacle assembly, the contact module comprising:

a frame assembly having first and second frames coupled together, the first and second frames each having a corresponding leadframe comprising a plurality of receptacle signal contacts, the first and second frames each having at least two frame members spaced apart from each other by a corresponding gap, each frame member being overmolded over and supporting corresponding receptacle signal contacts, the first and second frames being internested such that at least one frame member of the first frame is received in a corresponding gap of the second frame and such that at least one frame member of the second frame is received in a corresponding gap of the first frame;

wherein at least one of the receptacle signal contacts is supported by a corresponding removable insert during overmolding of the corresponding frame member, the removable insert leaving a window in the corresponding frame member exposing the corresponding receptacle signal contact; and wherein the first frame includes a first dielectric insert extending from a corresponding frame member of the first frame into the gap, the first dielectric insert being received in a corresponding window in the second frame to substantially fill the window and cover the corresponding receptacle signal contact of the second frame, and the second frame includes a second dielectric insert extending from a corresponding frame member of the second frame into the gap, the second dielectric insert being received in a corresponding window in the first frame to substantially fill the window and cover the corresponding receptacle signal contact of the first frame.

2. The contact module of claim 1, wherein the removable insert holds lateral positions of the receptacle signal contacts relative to other receptacle signal contacts during overmolding.

3. The contact module of claim 1, wherein the first dielectric insert has a complementary shape to the corresponding removable insert to substantially fill the window left by removal of the removable insert.

4. The contact module of claim 1, wherein the removable insert includes a main wall, end walls extending from the main wall and forming a receiving space therebetween, and a finger extending from the main wall in the receiving space, first and second channels being formed between the finger and the corresponding end walls, the first and second channels receiving the receptacle signal contacts, the finger and the end walls holding the lateral positions of the receptacle signal contacts relative to each other during the overmolding process, the receiving space being filled with dielectric material during overmolding of the corresponding frame member.

5. The contact module of claim 1, wherein the removable insert includes a finger positioned between the corresponding receptacle signal contacts to hold a lateral position of the receptacle signal contacts relative to one another.

6. The contact module of claim 1, wherein the removable insert maintains a predetermined spacing between a differential pair of receptacle signal contacts as the dielectric material of the frame member is overmolded to form the corresponding frame member.

7. The contact module of claim 1, wherein the frame members include edges facing corresponding gaps, the edges at the windows being inset such that the frame member is narrower at the window than along segments of the frame member adjacent the window.

8. The contact module of claim 1, wherein the second dielectric insert extends across a corresponding gap between adjacent frame members of the second frame.

9. The contact module of claim 1, wherein each of the first and second frames have opposing first and second sides, the frames having a thickness between the first and second sides, the first dielectric insert having a thickness approximately equal to the thickness of the second frame, the second dielectric insert having a thickness approximately equal to the thickness of the first frame.

10. The contact module of claim 1, wherein each of the first and second frames have opposing first and second sides, the first and second frames having a thickness between the first and second sides, the first dielectric insert having end walls and fingers received in the corresponding window of the second frame, the end walls and the fingers having a thickness approximately equal to the thickness of the second frame.

11. The contact module of claim 1, wherein the windows have angled side walls extending between the receptacle signal contacts and an exterior side of the corresponding frame member, the first and second dielectric inserts having angled side walls covering the corresponding receptacle signal contacts.

12. The contact module of claim 1, further comprising a conductive holder, the frame assembly being received in the conductive holder, the conductive holder providing electrical shielding for the frame assembly.

13. The contact module of claim 1, wherein the first and second frames are internested such that the frame members of the first and second frames are coplanar.

14. The contact module of claim 1, wherein the first frame is fabricated separate from the second frame and mechanically coupled thereto.

15. The contact module of claim 1, wherein the window has a longitudinal length approximately equal to a lateral width of the corresponding frame member.

16. A contact module for a receptacle assembly, the contact module comprising:

a frame having a leadframe comprising a plurality of receptacle signal contacts and frame members overmolded over corresponding receptacle signal contacts, the frame members being separated by corresponding gaps; and a removable insert coupled to at least one of the receptacle signal contacts, the removable insert having a main wall, end walls extending from the main wall and forming a receiving space therebetween, and a finger extending from the main wall in the receiving space, first and second channels being formed between the finger and the corresponding end walls, the first and second channels receiving the receptacle signal contacts, the finger and the end walls holding the lateral positions of the receptacle signal contacts relative to each other during the overmolding process, the receiving space being filled with dielectric material during overmolding of the corresponding frame member, the removable insert leaving a window in the corresponding frame member after the removable insert is removed, the window exposing the corresponding receptacle signal contact.

17. The contact module of claim 16, wherein at least one of the frame members comprises a dielectric insert extending therefrom, the dielectric insert having a complementary shape to the removable insert.

18. The contact module of claim 16, wherein at least one of the frame members comprises a dielectric insert extending therefrom, the dielectric insert having a main wall, end walls extending from the main wall and forming a receiving space therebetween, and a finger extending from the main wall in the receiving space, first and second channels being formed between the finger and the corresponding end walls, the first and second channels being configured to receive a frame member and corresponding receptacle signal contacts of a different frame.

19. The contact module of claim 16, wherein the removable insert maintains a predetermined spacing between a differential pair of receptacle signal contacts as the dielectric material of the frame member is overmolded to form the corresponding frame member.

20. The contact module of claim 16, wherein the frame is a first frame, and further comprising a second frame having at least two frame members spaced apart from each other by a corresponding gap and being overmolded over and supporting corresponding receptacle signal contacts, the second frame having a dielectric insert extending from a corresponding frame member of the second frame into the gap;

wherein the second frame is coupled to the first frame such that at least one of the frame members of the first frame is internested in the gap of the second frame, the dielectric insert being received in the window left by the removable insert to substantially fill the window and cover the corresponding receptacle signal contact.

* * * * *